United States Patent [19]

Marcotte

[11] Patent Number: 4,967,418

[45] Date of Patent: Nov. 6, 1990

[54] PROTECTIVE MITT

[76] Inventor: Harold J. Marcotte, 510 Aztec Drive, Oshawa, Ontario, Canada, L1J 7S6

[21] Appl. No.: 203,366

[22] Filed: May 27, 1988

[30] Foreign Application Priority Data

May 29, 1987 [CA] Canada ..... 538399

[51] Int. Cl.[5] ..... A41D 13/08

[52] U.S. Cl. ..... 2/16; 2/161 A

[58] Field of Search ..... 2/16, 19, 20, 159, 161 A

[56] References Cited

U.S. PATENT DOCUMENTS 2,558,544 6/1951 Delsalle ..... 2/19

3,626,515 12/1971 Murray ..... 2/16

4,027,339 6/1977 Brucker ..... 2/16

4,677,698 7/1987 Angas ..... 2/16

*Primary Examiner*—Ronald Feldbaum

*Attorney, Agent, or Firm*—Rogers, Bereskin & Parr

[57] ABSTRACT

A protective mitten for use by a hockey goalkeeper which has a catching portion separate from but interconnected with a gripping portion. The catching portion is shaped so as to enable a hockey puck to be caught and held therein. The gripping portion offers a better grip on the handle of a hockey stick than can be achieved by trying to grasp the handle in the catching portion.

20 Claims, 5 Drawing Sheets

PROTECTIVE MITT

This invention relates to a protective mitten as worn by goalkeepers in the sport of hockey, sometimes known as ice hockey.

The position of hockey goalkeeper requires the guarding of the goal. The goal is a rectangularly shaped vertical opening with a net behind it. To prevent the passage of the puck into the goal the goalkeeper can catch the puck or deflect the puck away from the opening by the use of the goalkeeper's stick.

The puck can travel at high speeds, particularly when struck by an opposing player in an attempt to score a goal. Accordingly, current practice is for the goalkeeper to wear a substantial amount of protective equipment. This includes pads covering most of the legs and a face mask to protect against flying pucks. On one hand the goalkeeper has a glove, with separate fingers and a thumb. This is usually worn on the goalkeeper's writing hand. It also usually has, as an integral part of the glove but not attached to the fingers, a generally rectangular pad. The goalkeeper has a special stick that is of enlarged width or depth along the blade and its lower portion. In use, the goalkeeper will often grip the stick with just this one hand and hold the stick across in front of him. The rectangular pad then protects his fingers and hand. The other hand, i.e. the non-writing hand, is then used for catching the puck. For this purpose this other hand is provided with a mitt. The mitt has one large pocket for the four fingers and a small pocket for the thumb. Between the finger and thumb pockets there is a webbing and/or netting. With the fingers and thumb extended the mitt forms a generally hemispherical or dish shape, which aids in catching a puck.

Whilst this technique works well for defending the goal when the opposing team are attempting to score, the goalkeeper has little control of his stick when holding it with one hand. For a significant part of the time, the goalkeeper needs to use his stick with both hands, as for other players. Typically, when the puck comes loose and travels to the goalkeeper, without being a scoring attempt, the goal keeper has plenty of time to stop and control the puck with his stick; he can then pass it to another member of his team. This is extremely difficult to do with a convential keeper's mitt. The dish shape prevents the shaft of the stick being gripped, or at best enables the keeper to obtain a very poor grip on it. Consequently, the keeper is unable to control it or apply any significant controlled force to it. Thus, the goalkeeper is unable to make controlled passes to other members of his team over any distance.

This has a considerable impact on the way in which the game is played. If the goalkeeper gains control of the puck, it is customary for one of his team mates, usually one of the two defencemen to fall back to pick up the puck. The keeper then only has to make a short pass to that person. An attacking movement against the other team can then be started. Bearing in mind that each team only has 5 players, apart from the goalkeeper, the requirement for at least one player to fall back to pick up the puck has a considerable effect. Indeed, if the goalkeeper is forced to make anything more than the simplest play with his stick, he will often make a mistake. For this reason, the defencemen will fall back quickly to take the puck from the keeper.

It is desirable that the goalkeeper should be able to control his stick, so as to be able to make controlled passes over some distance. Thus, it is desirable that the keeper should be able to grip his stick firmly with both hands. He should the be able to make controlled passes.

In accordance with the present invention there is provided a protective mitt for a player using a stick, the mitt comprising:

a hand portion, comprising a finger portion and a thumb pocket connected to the finger portion, webbing means extending between the finger portion and the thumb pocket to enable the hand portion to be extendible for catching; and a gripping means extending from the outside of the hand portion and permitting a stick to be grasped by a least some of a user's fingers between the gripping means and the outside of the hand portion.

The protective mitt is preferably for hockey goalkeepers but can be used in any sport where players use a stick. Preferably the mitt is padded to further absorb impact and protect the wearer's hand. A first version of the protective mitt has separate finger pocket and gripping pocket interconnected with an opening allowing all or some of the wearer's fingers to be placed in either pocket. A second version has a finger pad portion and in this version at least some of the fingers are always outside of the finger pocket.

For a better understanding of the present invention, and to show more clearly how it may be carried into effect, reference will now be made, by way of example, to the accompanying drawings, which show preferred embodiments of the present invention and in which.

Figure 1:
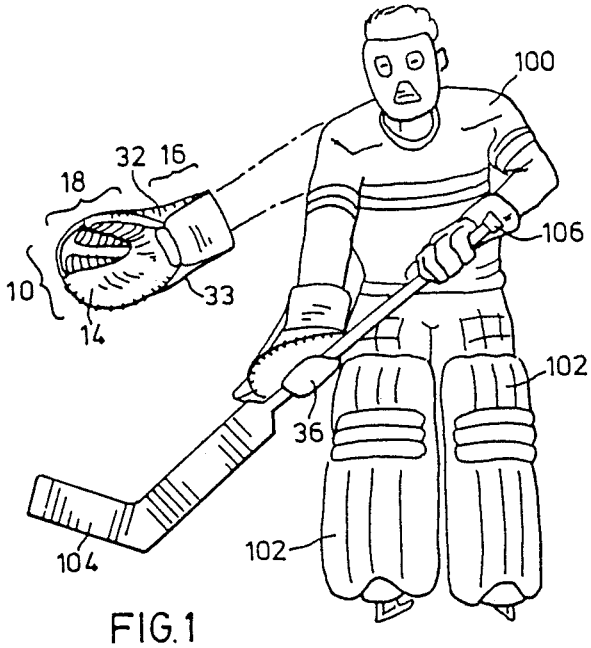
FIG. 1 is a front view of a goalkeeper using a mitt according to the present invention.

In FIG. 1, there is shown a goalkeeper indicated at 100. The goalkeeper 100, in a known manner is equipped with leg pads 102, and uses a conventional goalkeeping stick 104 with a shaft 105. On his left hand, the goalkeeper wears a glove 106. As can be seen, this glove includes separate finger sections, for each finger of the hand. Although not shown, in known manner, this glove 106 would be equipped with a large rectangular pad covering the front or outer surface, to deflect pucks and protect the hand. On his right hand, the goalkeeper has a mitt 10 in accordance with the present invention. The goalkeeper 100 shown is thus someone who is usually left-handed, so that the mitt is carried by the right hand. It will of course be appreciated that the mitt 10 and glove 106 would be reversed for a right handed player.

Figure 2:
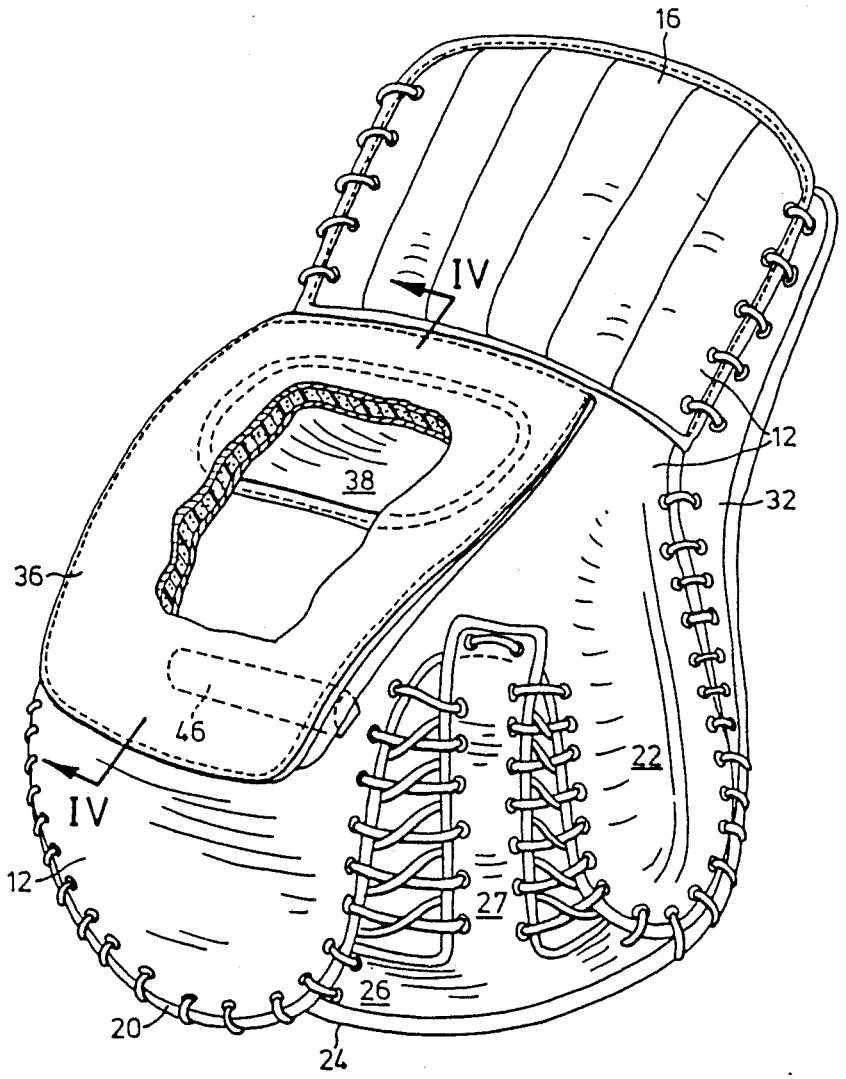
FIG. 2 is a perspective view of the mitt of FIG. 1, on a larger scale, with a portion cut away.

The mitt as illustrated in FIGS. 1 and 2 has an outside 12 and a palm side or inside 14 of similar overall shape. It is manufactured from a thin, flexible sheet material, such as leather, fabric, e.g. nylon, or vinyl cloth.

When laid flat and viewed in plan, the outside 12 and palm side 14 comprise a rectangular cuff 16 attached at one end to a hand portion 18 in FIG. 1.

The hand portion 18 has a generally "U" shaped finger pocket 20 from along one edge of which diverges a generally "U" shaped thumb pocket 22. The finger pocket 20 accommodates all the fingers and is relatively broad, whereas the thumb pocket 22 is relatively narrow. The rounded end of the thumb pocket 22 and the rounded end of the finger pocket 20 are remote from where the pockets 20, 22 join. The angle of divergence of the thumb pocket from the finger pocket is less than 90°.

The cuff 16 joins with the hand portion 18 at the end of the hand portion 18 opposite the rounded end of the finger pocket. The cuff, finger pocket and thumb pocket can be joined where they meet by a suitable attachment means such as stitching or they can be integrally formed on each side, from the same sheet of material.

The outside 12 of the mitt 10 is joined to the palm side 14 around their respective perimeters to form the pockets 20, 22, and to leave the end of the cuff remote from the hand portion open so that a hand may be inserted into the cavity between the sides 12, 14. Such joinder is achieved by any means common in the art such as stitching or lacing.

Webbing 24 is provided between the finger and thumb pockets 20, 22. Webbing 24 has a peripheral strip 26 and a central strip 28, binding the angle between the thumb and finger pockets 20, 22. Lacing 30 secures the webbing 24 to the pockets 20, 22.

Along either edge of the mitt 10, there are additional side strips 32,33. These side strips 32,33 are secured by lacing 34. The side strips 32 can be a continuation of the webbing 24. Whilst the side strip 33 is shown, this could be omitted; this would follow many conventional designs which only include the side strip 32.

The hand portion of the mitt 10 in its open position, as shown in FIG. 1, is of a generally hollow, hemispherical or dish shape.

The hand portion 18 is pliable and can be folded along a line running approximately along the center line of the central strip 27 of the webbing between the finger and thumb pockets 20, 22, and diagonally across the hand portion to approximately where the cuff 16 meets the hand portion on the side of the mitt 10 opposite the thumb pocket 22. The mitt 10 can be flexed in this manner by the goalkeeper's hand inside the mitt. Such flexion is used to enable the wearer to catch a hockey puck with the mitt 10. The mitt 10 is held open as in FIG. 1, and then closed as soon as a puck enters it pressing the pockets 20, 22 together to pinch the puck between the thumb pocket 22 and the finger pocket 20.

In accordance with the present invention, over or outside the outside surface of the finger pocket 20 is a gripping pocket 36 of generally rectangular or U shape. The outer surface of the finger pocket 20 is designated 21, and the gripping pocket 36 is secured to it. This outer surface 21 includes an opening 38 that is of a generally rounded rectangular shape extending across most of the width of the finger pocket 20. The edge of the opening 38 can be protected, in known manner, by a strip of material bound to it. The opening 38 is of a size and shape to permit smooth and easy transfer of the fingers between pockets 20, 36.

The gripping pocket 36 has an outside panel 40 and an inside panel 42. The panels 40, 42 are secured together in known manner, for example by stitching, along their perimeters. Further, the panels 40, 42 are secured to the outside 12, around the opening 38. One edge of the outside panel 40 is attached to the outside 12, for example by sewing, where the finger pocket 20 meets the cuff 16; the inside panel 42, along one edge, is joined to the outer surface 21, at an edge of the opening 38, by suitable means such as stitching or glueing.

Whilst the gripping pocket 36 is shown as being generally rectangular with a rounded end, many different configurations are possible. Thus, the pocket 36 could be generally triangular or oval, or it could be provided with separate finger pockets.

Figure 4:
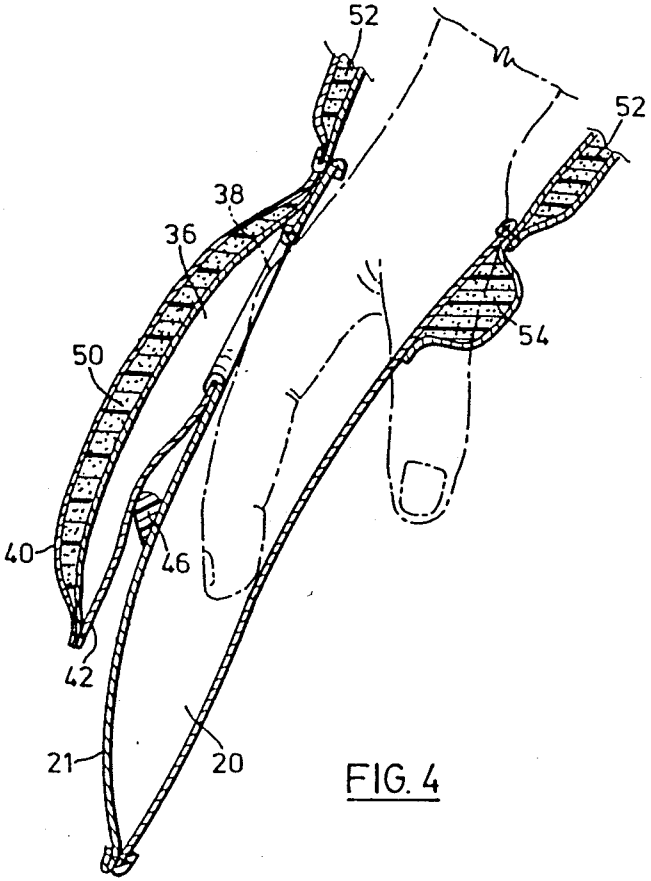
FIG. 4 is a sectional view along Line IV—IV in FIG. 2, and showing a hand in the mitt.

The mitt 10 is padded to protect the user's hand from injury when the mitt is struck such as by a hockey puck travelling at high speed or a hockey stick. Padding can be achieved by making the portions of the mitten where protection is required of a double-layer construction with a shock-absorbing material between the two layers. Such padding is illustrated in FIG. 4 with reference 50 showing padding on the outside panel 40 of the gripping pocket 36, reference 52 showing padding on the cuff 16 and no. 54 showing padding on the heel of the inside 14. The flexibility and position of the padded segments must of course be consistent with the required movement of the mitt 10 such as in gripping a hockey stick 104 as shown in FIG. 5 or in catching a puck as described above.

While padding 50 is shown on the outside of the gripping pocket 36, padding could alternatively, or as well, be provided on the outside of the finger pocket 20, extending from its tip to the opening 38.

As an optional feature, the outside of the finger pocket 20 can be provided with a support block 46, against which the shaft of a hockey stick can be pressed. The shape of this block and it location could be varied, as desired.

Figure 3:
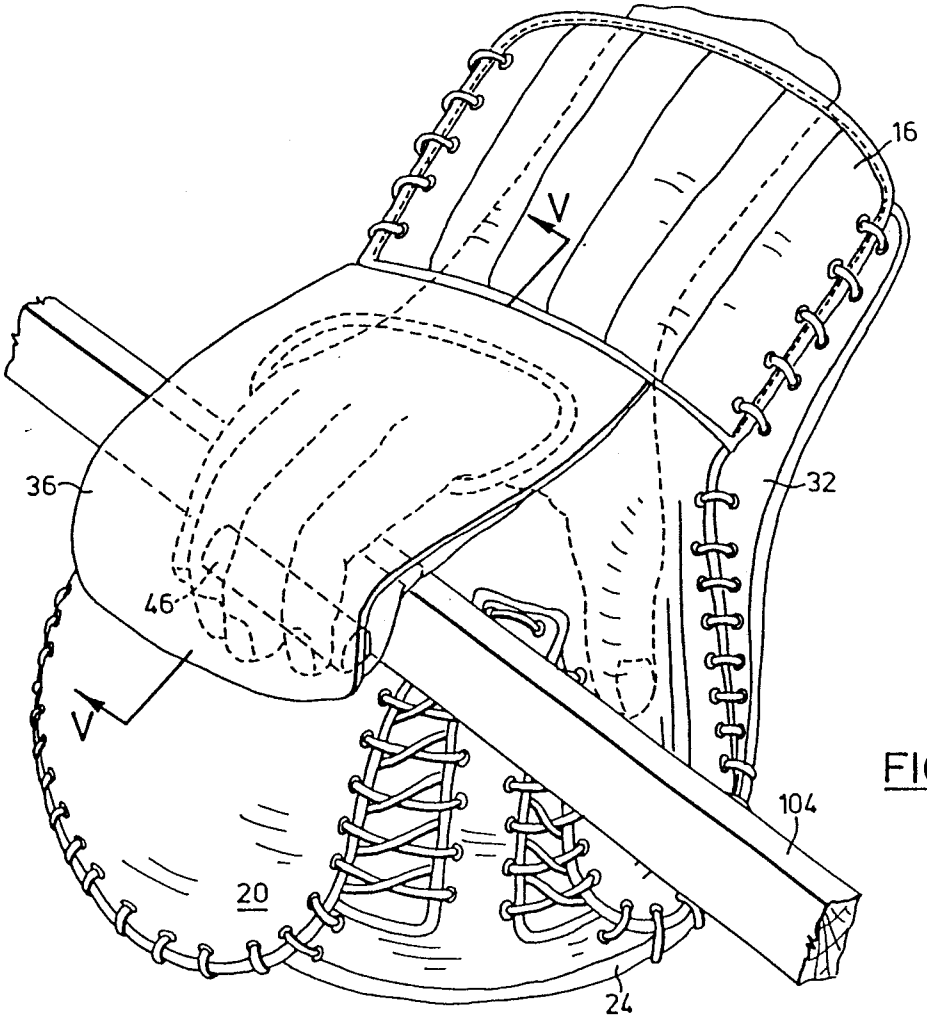
FIG. 3 is a perspective view, similar to FIG. 2, in a gripping mode and showing a user's hand in outline.
Figure 5:
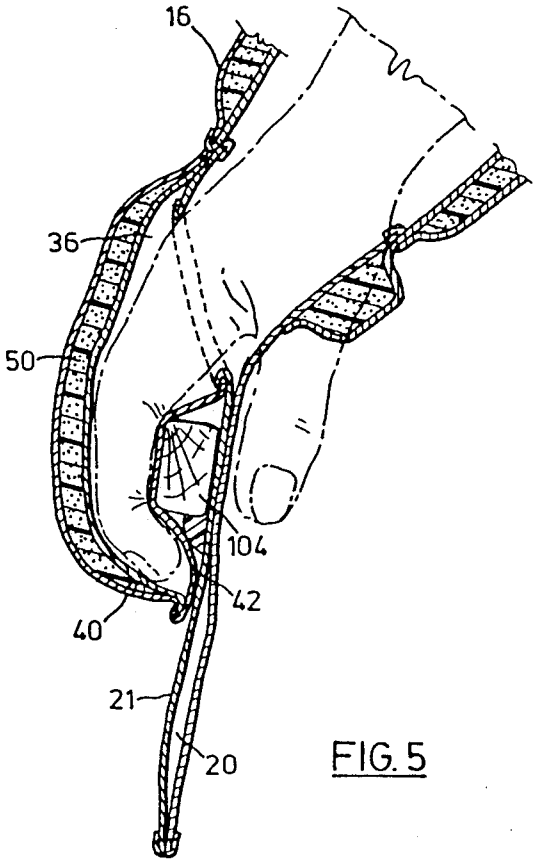
FIG. 5 is a sectional view along Line V—V of FIG. 3.

In use, the goalkeeper 100 has his hand in the finger and thumb pockets 20, 22, as shown in FIGS. 3, 4 and 5, the goalkeepers fingers being designated by the reference 108 and his thumb by the reference 109. The thumb 109 always remains in the thumb pocket 22.

For conventional catching of a puck, the fingers 108 are maintained in the finger pocket 20, as shown in FIG. 4. The hand can then be held outstreched, to catch a puck. Then, as mentioned above, the finger and thumb pockets 20, 22 can be pressed together to grip the puck. During this action, the gripping pocket 36 is empty, and as it is on the outside or rearside of the finger pocket 20, it does not interfere with this action.

Now, during a hockey game, the play requiring use of the mitt 10 in the catching mode, and play requiring the stick 104 to be gripped are often quite distinct. Consequently, the goalkeeper has a reasonable amount of time in which to determine what type of play is required.

When the keeper 100 is required to grip the stick 104, he will remove his fingers 108 from the finger pocket 20 and insert them through the opening 38 into the griping pocket 36. In this respect, the finger pocket 20 is usually relatively large, and is not a close or tight fit on the fingers. Thus, the user has plenty of space in which to manipulate his fingers through the opening 38.

The keeper 100 can then grip the shaft 105 of the stick 104 with both hands. Whereas for single handed use, the gloved hand 106 is maintained down the shaft 105, for two handed use the gloved hand 106 grips the top of the shaft 105. The lower part of the shaft 105 is then inserted between the inside panel 42 or the gripping pocket 36 and the outside of the finger pocket 20. This is shown in FIG. 5. As can be seen, this enables the keeper to use the gripping action of his thumb 109. The thumb 109 is used to press the shaft 105 against the fingers 108. This is achieved by the thumb 109 pressing through the two layers of the finger pocket 20.

It is to be realized that the keeper 100 does not need a particularly delicate or sensitive grip of the shaft 105 with any one hand. The most important factor is for him to have a secure grip on the shaft 105 with both his hands. The mitt 10 of the present invention enables this to be achieved The keeper 100 can then manipulate the stick 104 as required.

It is expected that the keeper 100 can then manipulate the stick 104, in much the same manner as any other player on the team. Whilst the mitt 10 may not enable the stick 104 to be gripped as well as with a conventional glove, the keeper 100 should have good control over it. Consequently, it is expected that he should be able to make controlled passing shots. Other players of his team will not then need to come back to him to receive passes which can be short or of some length. They can remain further towards the opponent's goal, thereby facilitating an attacking movement.

Where the optional support block 46 is provided, the hockey stick shaft 105 is pressed by the fingers 108 in the gripping pocket 36 against it, to securely hold the stick 104.

An alternate method for using the gripping pocket is for the goalkeeper to keep three fingers in the gripping pocket with his thumb in the thumb pocket and his little finger (fifth finger) in the finger pocket. This method of using the mitt (not shown) allows alternately gripping the stick 104 between the gripping pocket 36 and finger pocket 20 by use of the three fingers in the finger pocket, or catching a puck by flexing the mitt 10 to open it using mainly the thumb and little finger to effect this flexion. Thus if the goalkeeper does not have time to return his fingers from the gripping pocket 36 into the finger pocket 20 he can still use the mitt 10 to catch a puck.

Figure 7:
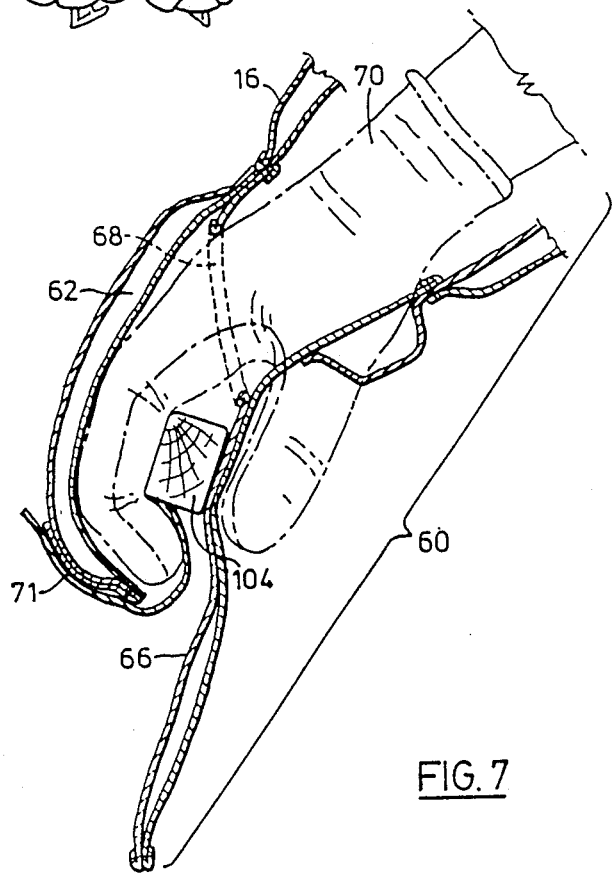
FIG. 7 is a sectional view along Line VII—VII of FIG. 6.
Figure 6:
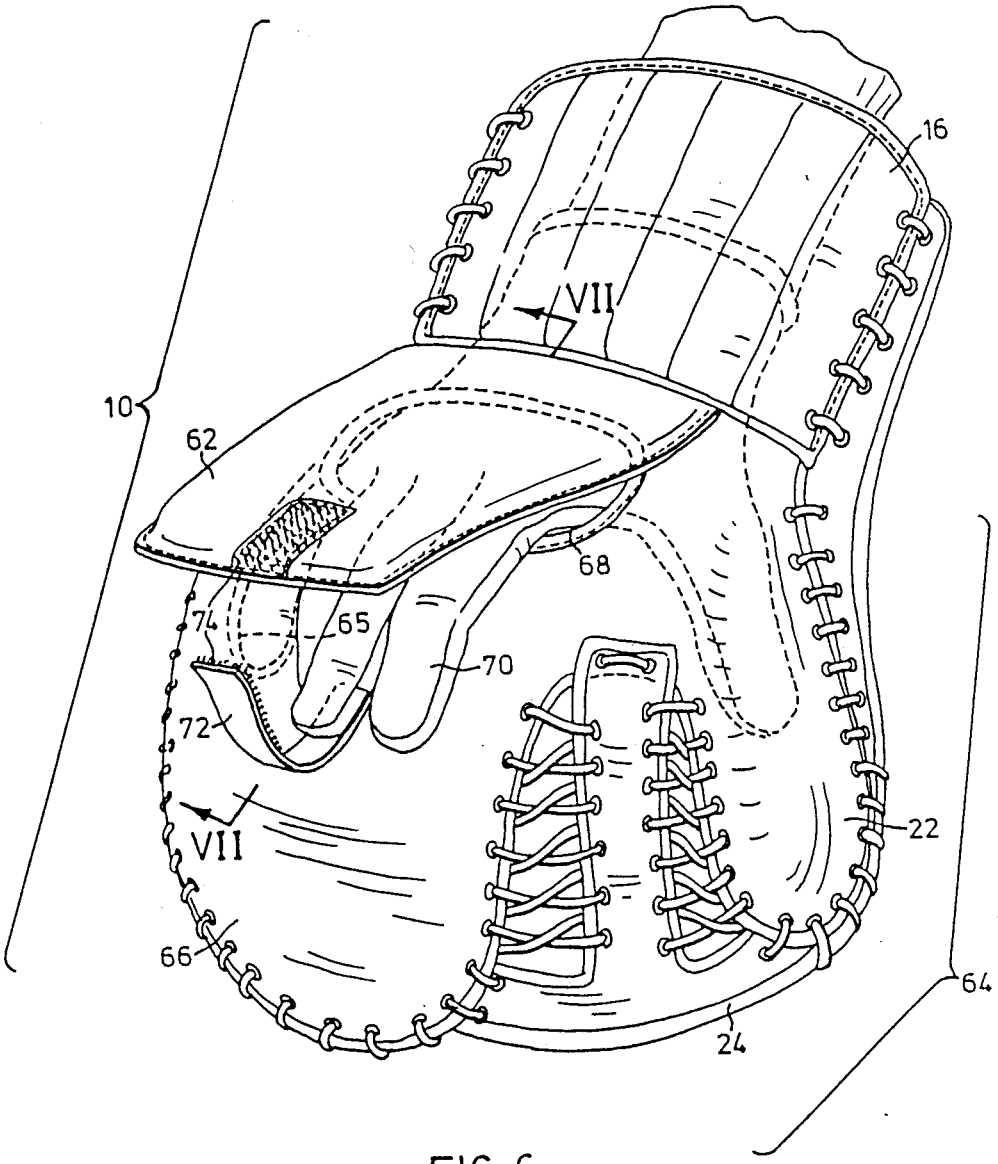
FIG. 6 is a perspective view similar to FIG. 3, of a second embodiment of the present invention.

The second embodiment of the invention is shown in FIGS. 6 and 7 and will now be described. This second embodiment is given the reference 60. Many of the parts of the mitt 60 are the same as in the mitt 10. For simplicity and briefly, these parts are given the same references, and their description is not repeated.

In this second embodiment a protective finger flap 62 is used instead of a gripping pocket. This flap 62 is of generally rectangular shape and one edge of the flap 62 is attached to the outside 12 of the mitt 10 approximately where a hand portion 64 meets the cuff 16. Attachment may be by any suitable means such as stitching. The protective flap 62 is large enough to cover the fingers. The flap 62 is padded so as to protect the fingers beneath it from high speed hockey puck impacts.

In this second embodiment, the hand portion 64 is configured slightly differently from the hand portion 18 of the first embodiment. The hand portion 64 is of the same general overall profile. The hand portion 64 again includes the narrow U-shape thumb pocket 22. However, the finger pocket 20 is replaced by a little or fifth finger pocket 65. The hand portion 64 includes a finger pad portion 66. This finger pad portion 66 and the pocket 65 are of the same general profile as the finger pocket 20. The finger pad portion 66 can further be configured or shaped on its rear or outerside, to form a recess for receiving the users three middle fingers. The finger pad portion 66 includes an opening 68, through which the users three middle fingers are inserted.

In association with the embodiment of the mitt 60 shown in FIGS. 6 and 7, a protective inner glove 70 is worn by the user of the mitt 60. The glove 70 provides both a finger pocket for catching and a gripping pocket for gripping the stick. The glove 70 can be a thin glove or, for example, leather or fabric, similar to a golf glove.

A retaining means 71 is provided on the protective glove 70, for securing it to the protective flap 62, to prevent the flap 62 from lifting away from the glove allowing a hockey puck to strike the protective glove 70 and injure the users hand.

The retaining means 71 comprises a short strap 72 fastened to the middle finger of the protective glove 71. This strap 72 is releasably attached to the protective flap 62 by means of fastener strips 74 sold under the trade mark "Velcro". Other fasteners, such as domed fasteners could be used In use, the user would first fit the protective inner glove 71. The glove 71 would then be inserted into the mitt 60, with the thumb extending in to the thumb pocket 22 the three middle fingers extending through the opening 68 and the little finger inserted in the pocket 65. The fastener strips 74 would then be secured, to attach the glove 70 to the pad 62.

In use, for catching, the user would hold his hand open as before, and catch the puck in the hand portion 64. The thumb and little fingers help to hold the mitt 60 in the open position. To grip the puck, the finger pad portion 66 can be pressed by the fingers against the thumb pocket 22, to grasp the puck between them.

To grip the hockey stick 104, the hockey stick 104 is slipped between the three middle fingers in the glove 71 and the finger pad portion 66. The users fingers then press the stick against the finger pad portion 66, with the users thumb pressing against the other side of the finger pad portion 66. This again allows a secure two handed manipulation of the stick 104.

Because of the retaining means 70, the fingers cannot be slipped into a finger pocket, hence control of the mitt when catching may be lessened. However, this arrangement has the advantage of not requiring the user to move his fingers between gripping and finger pockets. The number of fingers placed in the pocket 65, and hence its size can be varied. The little finger pocket 65 can be omitted. This has the advantage that all four fingers would be free to grip the hockey stick shaft 105. However, this would not provide as great control for catching, and the use would rely on the natural tendency of the glove to spring open for catching. In this respect, the mitt 10 can be given resilient properties, tending to adopt the catching configuration.

It is to be understood that what has been described are preferred embodiments of the invention and it is possible to make variations to these embodiments while staying within the scope of the invention.

I claim:

1. A protective mitt for a player using a stick, the mitt comprising: a hand portion, comprising a finger portion and a thumb pocket connected to the finger portion, webbing means extending between the finger portion and the thumb pocket to enable the hand portion to be extendable for catching; and a gripping means extending from the outside of the hand portion and permitting a stick to be grasped by at least some of a user's fingers between the gripping means and the outside of the hand portion.

2. A protective mitt as in claim 1 wherein the finger portion comprises a finger pocket for at least some of the user's fingers and having an outer surface and an opening in the outer surface; and the gripping means comprises a gripping pocket extending from the outer surface of the finger pocket and the interior of which interconnects with the interior of the finger pocket through the said opening to allow at least some of the wearer's fingers to be alternately placed in the finger pocket or the gripping pocket.

3. The protective mitt as claimed in claim 2, wherein the gripping pocket comprises separate inner and outer panels.

4. The protective mitt as claimed in claim 3, which includes a cuff extending from the hand portion, with the gripping pocket extending from a junction between the cuff and the hand portion.

5. A protective mitt as claimed in claim 1, wherein the finger portion comprises a finger pad portion, an opening for at least some of a user's fingers and a finger flap covering the opening, and wherein the mitt includes an inner glove providing finger pocket and the gripping means, the inner glove being connected to the finger flap, with the fingers of the inner glove extending through said opening to fit between the finger pad portion and the flap.

6. A protective mitt as claimed in claim 5, wherein the finger pad portion includes a second finger pocket remote from the thumb pocket for at least one of the user's fingers.

7. A protective mitt as claimed in claim 6, wherein the finger pad portion is shaped to form a recess for the fingers not within the second finger pocket.

8. A protective mitt as claimed in claim 5, 6 or 7, wherein the inner glove is releasably connected to the finger flap by retaining means.

9. A protective mitt as claimed in claim 5, 6 or 7, wherein the middle finger of the inner glove includes a strap, and the strap is releasably connected to the flap by retaining means.

10. A protective mitt as claimed in claim 1, 3 or 5, wherein the webbing means comprises a peripheral strip extending between the finger portion and the thumb pocket, a central strip extending between the peripheral strip and a junction between the finger portion and the thumb pocket, and lacing provided between the peripheral and central strips and the thumb pocket and the finger portion.

11. A protective mitt as claimed in claim 1, 3 or 5, wherein the webbing means comprises a peripheral strip extending between the finger portion and the thumb pocket, a central strip extending between the peripheral strip and a junction between the finger portion and the thumb pocket, and lacing provided between the peripheral and central strips and the thumb pocket and the finger pocket, and which further includes side strips extending down either side of the hand portion and secured by lacing.

12. A protective mitt as claimed in claim 1, 3 or 5, which includes a support block mounted on the outside of the finger portion.

13. A protective mitt as claimed in claim 1, 3 or 5, which includes padding on the outside of the glove.

14. A protective mitt as claimed in claim 1, 3 or 5, which includes a cuff extending from the hand portion, and which includes padding on the outside of the cuff and of the hand portion, and padding on the heel of the inside of the finger portion.

15. A protective mitt as claimed in claim 1, 3 or 5, wherein the webbing means comprises a peripheral strip extending between the finger portion and the thumb pocket, a central strip extending between the peripheral strip and a junction between the finger portion and the thumb pocket, and lacing provided between the peripheral and central strips and the thumb pocket and the finger portion, wherein a support block is provided on the outside of the finger portion, and wherein a cuff is provided extending from the hand portion, with the outside of the hand portion and the cuff including padding.

16. A protective hockey goalkeeper's mitt, which comprises: a hand portion, comprising a finger portion and a thumb pocket connected to the finger portion, webbing means extending between the finger portion and the thumb pocket to enable the hand portion to be extendable for catching a hockey puck; and a gripping means extending from the outside of the hand and permitting a hockey stick to be grasped by at least some of a user's fingers between the gripping means and the outside of the hand portion.

17. A protective mitt as in claim 16, wherein the finger portion comprises a finger pocket for at least some of the user's fingers and having an outer surface and an opening in the outer surface; and the gripping means comprises a gripping pocket extending from the outer surface of the finger pocket and the interior of which interconnects with the interior of the finger pocket through the said opening to allow at least some of the wearer's fingers to be alternately placed in the finger pocket or the gripping pocket.

18. A protective mitt as claimed in claim 17, wherein the finger portion comprises a finger pad portion, an opening for at least some of a user's fingers and a finger flap covering the opening, and wherein the mitt includes an inner glove providing a finger pocket and the gripping means, the inner glove being connected to the finger flap, with the fingers of the inner glove extending through said opening to fit between the finger pad portion and the flap.

19. A protective mitt as claimed in claim 18, wherein the finger pad portion is shaped to form a recess for the fingers not within the second finger pocket.

20. A protective mitt as claimed in claim 16, 17 or 18, wherein the webbing means comprises a peripheral strip extending between the finger portion and the thumb pocket, a central strip extending between the peripheral strip and a junction between the finger portion and the thumb pocket, and lacing provided between the peripheral and central strips and the thumb pocket and the finger portion, and wherein a cuff is provided extending from the hand portion, with the outside of the hand portion and the cuff including padding.

* * * * *